United States Patent [19]

Pruit

[11] Patent Number: 4,862,536

[45] Date of Patent: Sep. 5, 1989

[54] BACK SUPPORT DEVICE

[76] Inventor: J. Douglas Pruit, 3009 Glen Hollow Cir., Carrollton, Tex. 75007

[21] Appl. No.: 164,549

[22] Filed: Mar. 7, 1988

[51] Int. Cl.[4] ..... A47C 7/38

[52] U.S. Cl. ..... 5/432; 5/437; 297/397

[58] Field of Search ..... 5/431–434, 5/436, 437; 297/391, 397, 398, 394, 284, 230, 353; 24/129

[56] References Cited

U.S. PATENT DOCUMENTS

| | | | |
|---|---|---|---|
| 2,307,331 | 1/1943 | Parker, Jr. | 297/284 X |
| 2,582,571 | 1/1952 | Thoma | 297/397 |
| 2,812,804 | 11/1957 | Sandor | 297/284 X |
| 3,178,222 | 4/1965 | Anderson et al. | 24/129 X |
| 3,195,953 | 7/1965 | Zacks | 297/397 |
| 3,348,880 | 10/1967 | Swann | 297/230 |
| 3,542,421 | 11/1970 | Ambrose | 297/230 |
| 3,608,964 | 9/1971 | Earl | 297/397 |
| 4,161,337 | 7/1979 | Ross | 297/230 |
| 4,259,757 | 4/1981 | Watson | 5/434 |
| 4,512,047 | 4/1985 | Johnson | 5/432 |
| 4,597,386 | 7/1986 | Goldstein | 5/432 X |

*Primary Examiner*—Gary L. Smith
*Assistant Examiner*—Michael F. Trettel
*Attorney, Agent, or Firm*—Hubbard, Thurman, Turner & Tucker

[57] ABSTRACT

Disclosed is a back support device. The back support device includes a bonnet adapted to be connected to a seat back. A pair of spaced apart flexible guide straps is connected to the bonnet and at least one inflatable support cushion is slidingly mounted on the guide straps so as to be positionable at any desired location along the guide straps to provide support for a portion of the body of a user.

12 Claims, 1 Drawing Sheet

BACK SUPPORT DEVICE

BACKGROUND OF THE INVENTION

A. Field of the Invention

The present invention relates generally to back support devices, and more particularly to a back support device including inflatable cushions positionable at desired locations to support the back and head of a person seated in a chair or seat.

B. Description of the Prior Art

Seats in conveyances such as airplanes, busses, trains, and automobiles, are designed to provide a level of comfort that is generally acceptable to most people. However, because of differences among people in anatomy and health or fitness, no such seat is entirely comfortable for every person. Additionally, while such seats are reasonably comfortable for most people, they are not optimally comfortable for anyone.

In order to make seats in conveyances optimally comfortable, it would be necessary to custom make the seat for each individual user. However, such customization would, of course, be impractical.

There have been proposals for devices that may be fitted on a seat back to enable a person to conform the seat back better to his or her anatomy. However, no prior proposal has been entirely satisfactory.

It is therefore an object of the present invention to provide an improved back support device that overcomes the shortcomings of the prior art. More particularly, it is an object of the present invention to provide a back support device that allows the user to precisely position cushioning members for optimal comfort. It is a further object of the present invention to provide a back support device in which the firmness of the cushioning members is controllable by the user. It is yet a further objection of the present invention to provide a back support device that may be folded into a small compact size that can easily fit into a purse or briefcase when it is not in use.

SUMMARY OF THE INVENTION

Briefly stated, the foregoing and other objects are accomplished by the back support device of the present invention, which includes a bonnet adapted to be connected to a seat back. A pair of spaced apart flexible guide straps are connected to the bonnet. The guide straps depend from the bonnet and overlie the surface of the seat back. A plurality of inflatable support cushions are mounted to be positionable at any desired location along the guide straps.

Preferably, three support cushions are provided including, one for the head, one for the lumbar or lower back region, and one for the sacroiliac region of the back. The user positions the cushions along the guide straps so as to correspond most comfortably with his or her anatomy. The user can inflate the cushion simply by blowing them up with his or her mouth. The user can inflate the cushion to any desired level of firmness. When the back support device is not in use, the cushions may be deflated and it can be folded or rolled up to fit into a small space.

DESCRIPTION OF THE PREFERRED EMBODIMENT

Figure 1:
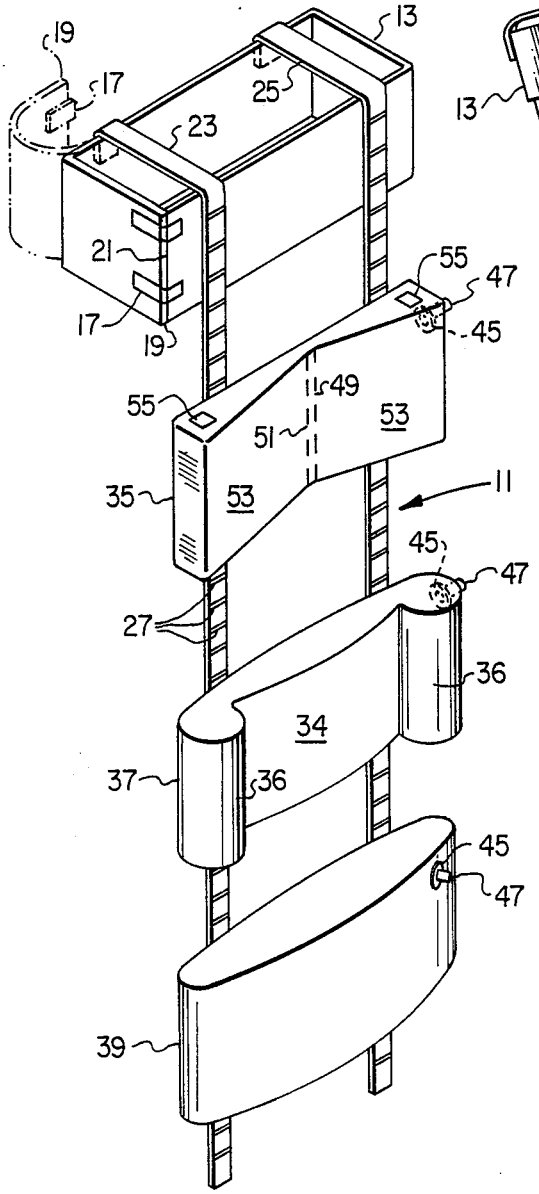
FIG. 1 is a perspective view of the back support device of the present invention.

Referring now to the drawing, the back support device of the present invention is designated generally by the numeral 11. Back support device 11 includes a bonnet 13 that is adapted to be fastened about the upper portion of a seat back 15. In the preferred embodiment, bonnet 13 is a belt of plastic material such as vinyl. Tabs of VELCRO 17 are attached at the free ends 19 and 21 of bonnet 13. VELCRO tabs 17 allow bonnet 13 to be snugly fastened about seat backs of various sizes.

Figure 3:
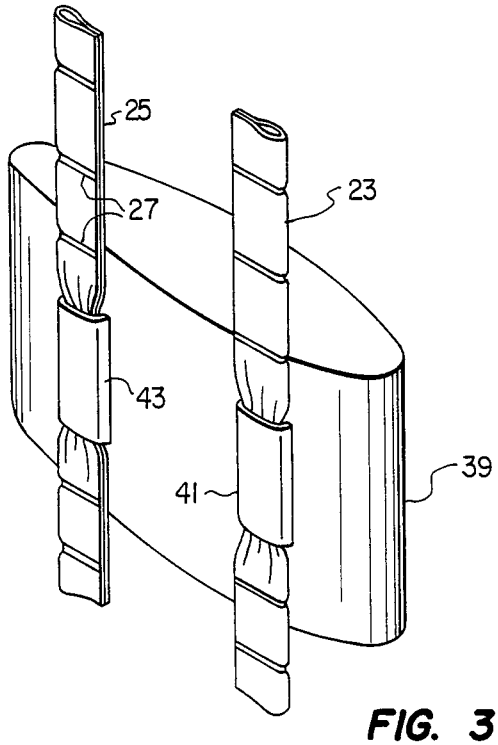
FIG. 3 is a partial perspective view showing details of the connection between a support cushion and the guide straps of the present invention.

Bonnet 13 has connected thereto a pair of spaced apart flexible guide straps 23 and 25. As is best shown in FIG. 3, guide straps 23 and 25 are folded-over strips of plastic, such as vinyl, that are heat sealed down one edge to form a flattened tubular structure. Each guide strap 23 and 25 includes a plurality of widthwise extending ribs 27 that impart transverse stiffness to the guide straps 23 and 25. Ribs 27 are preferably formed by heat sealing.

Guide straps 23 and 25 are attached to the back side of bonnet 13 by a heat sealing technique and they are adapted to extend over the top 29 of seat back 15 when bonnet 13 is in position and extend downwardly over the front side 31 of seat back 15. The lengths of guide straps 23 and 25 are selected to be long enough to reach at least to the bottom seat cushion 33 of the seat.

A plurality of inflatable support cushions are slidingly mounted on guide straps 23 and 25. The support cushions include a head support cushion 35, a lower back or lumbar support cushion 37, and a sacroiliac support cushion 39. Referring particularly to FIG. 3, sacroiliac support cushion 39 is slidingly mounted on guide straps 23 and 25 by means of sleeves 41 and 43, respectively.

Referring still to FIG. 3, the inflatable cushions, including sacroiliac support cushion 37, are preferably made of a plastic material, such as vinyl, and sleeves 41 and 43, which are also preferably made of vinyl, are connected to the back side of cushion 37 by heat sealing. It will be noted that the width of each sleeve 41 and 43 is less than the normal width of each guide strap 23 and 25. Thus, there is a slight interference fit between the sleeves and the straps, which causes cushion 39 to remain at any desired location to which it is slid along guide straps 23 and 25. Ribs 27, which increase transverse stiffness of straps 23 and 25, enhance the interference fit. Head support cushion 35 and lumbar support cushion 37 are slidingly mounted on guide straps 23 and 25 by sleeves in the same way as sacroiliac support cushion 39.

Head support cushion 35 is basically a plastic bag that is inflatable by means of an air valve 45. Air valve 45 is of the commonly available type used, for example, on inflatable toys such as beach balls and the like. Air valve 45 includes a tube 47 that is extended when head support cushion 35 is being blown up, but which may be recessed into head support cushion 35 when not in use.

Head support cushion 35 includes a midline depression 49 formed by heat sealing along the midline of head support cushion 35. The heat sealing is broken at various points to form passages 51 for the passage of air back and forth along midline 49 so that only one air valve 45 is necessary.

Midline depression is positioned behind the back of the head of a person using back support device 11. On either side of midline depression 49 there is formed a cushioning portion 53 that supports the head of the user. Head support cushion 35 preferably includes VELCRO tabs 55 that allow a towel-like cover (not shown) to be attached to head support cushion 35 to act as a replaceable cover if desired.

Lumbar support cushion 37 is a plastic bag preferably made of vinyl or the like. Lumbar support cushion 37 includes a flat center portion 34 with cylindrical portions 36 on its sides. Center portion 34 is positionable behind the small of the back of the user and cylindrical portions 36 extend slightly around the sides of the user to provide comfortable support and lateral stability to the lower back. Lumbar support cushion 37 is inflatable by means of an air valve 45 having tube 47 substantially similar to the air valve of head support cushion 35.

Sacroiliac support cushion 39 is also a plastic bag preferably made of vinyl. Sacroiliac cushion 39 is positionable behind the hips of the user and it is inflatable by means of an air valve 45 having tube 47, which, again, is substantially similar to the air valves of head support cusion 35 and lumbar support cushion 37.

Figure 2:
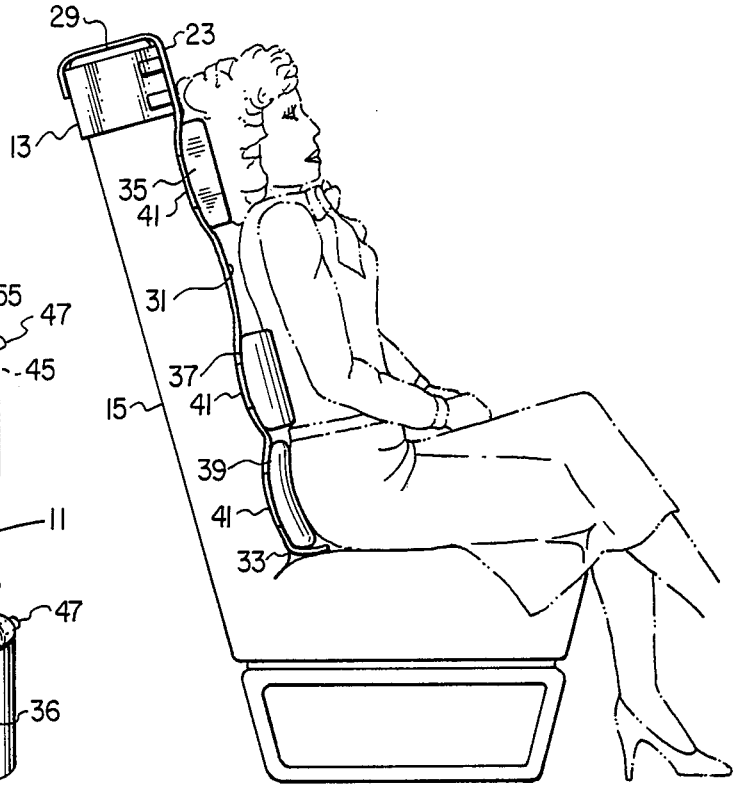
FIG. 2 is a side view showing the back support device of the present invention in use.

In operation, referring to FIG. 2, the user fastens bonnet 13 around seat back 15 with guide straps 23 and 25 depending down front 31 of seat back 15. The user inflates each support cushion 35, 37, 39 and positions them in a comfortable manner. More specifically, head support cushion 35 is positioned behind the back of the head, lumbar support cushion 37 is positioned in the small of the back, and sacroiliac support cushion 39 is positioned behind the hips. The position of each support cushion 35, 37, 39 is independent of the position of the others and the user may adjust the amount of air in each cushion to achieve optimum firmness and comfort. When the user arrives at her destination, she simply deflates the cushions 35, 37, 39 and removes bonnet 13. Back support device 11 may be then folded up into a compact package that can fit in a purse or briefcase.

Further modifications and alternative embodiments of the device of this invention will be apparent to those skilled in the art in view of the description. Accordingly, this description is to be construed as illustrative only and is for the purpose of teaching those skilled in the art the manner of carrying out the invention. It is to be understood that the form of the invention herewith shown and described is to be taken as the presently preferred embodiment. Various changes may be made in the shape, size, and arrangement of parts. For example, equivalent elements or materials may be substituted for those illustrated and described herein, parts may be reversed, and certain features may be used independently of other features, all as would be apparent to one skilled in the art after having the benefit of this description of the invention.

What is claimed is:

1. A back support device, which comprises:

a bonnet adapted to be connected to a seat back;

a pair of spaced apart flexible guide straps connected to said bonnet, each of said guide straps including means for providing transverse stiffness to said guide straps;

and an inflatable lumbar support cushion including spaced apart sleeves for receiving said guide straps so that said lumbar support cushion is slidingly mounted on said guide straps, wherein the width of said sleeves is less than the width of said guide straps, said lumbar support cushion being positionable at any desired location along said guide straps.

2. The back support device as claimed in claim 1, including an inflatable head support cushion slidingly mounted on said guide straps between said bonnet and said lumbar support.

3. The back support device as claimed in claim 2, wherein said head support cushion includes a midline depression with cushioning portions on either side thereof.

4. The back support device as claimed in claim 2, wherein said head support cushion includes means for attaching a cover thereto.

5. The back support device as claimed in claim 1, including an inflatable sacroiliac cushion slidingly mounted on said guide straps outwardly of said lumbar cushion.

6. The back support device as claimed in claim 1, wherein each of said guide straps includes an elongated plastic sheet folded widthwise and sealed along its edges to form a tube, and said transverse stiffness means includes a plurality of transverse ribs formed in said guide strap.

7. The back support device as claimed in claim 6, wherein said transverse ribs are formed by heat sealing.

8. The back support device as claimed in claim 1, wherein said bonnet includes:

a belt positionable about said seat back; and, means for securing said belt about said seat back.

9. The back support device as claimed in claim 1, wherein said lumbar support cushion includes a substantially flat center portion and a pair of cylindrical portions spaced apart on opposite sides of said center portion.

10. A back support device, which comprises:

a bonnet adapted to be connected to a seat back;

a pair of spaced apart flexible guide straps connected to said bonnet, each of said guide straps including means for providing transverse stiffness to said guide straps;

and a plurality of inflatable cushions slidingly mounted on said guide straps, wherein each of said cushions includes a pair of spaced apart sleeves for receiving said guide straps, wherein the width of said sleeves is less than the width of said guide straps.

11. A back support device, which comprises:

a guide strap including means for providing transverse stiffness to said guide strap;

an inflatable cushion positionable at a selected location on said guide strap, said cushion including a sleeve slidingly mounted on said guide strap, the width of said sleeve being less than the width of said guide straps;

and means for connecting said guide strap to a seat back.

12. The back support device as claimed in claim 11, wherein said means for connecting said guide strap to said seat back includes a bonnet connected to said guide strap, said bonnet being adapted to be connected to said seat back.

* * * * *